US011192179B2

(12) United States Patent
Spitans et al.

(10) Patent No.: US 11,192,179 B2
(45) Date of Patent: Dec. 7, 2021

(54) LEVITATION MELTING METHOD USING AN ANNULAR ELEMENT

(71) Applicant: ALD VACUUM TECHNOLOGIES GMBH, Hanau (DE)

(72) Inventors: Sergejs Spitans, Hanau (DE); Henrik Franz, Freigericht-Horbach (DE); Bjoern Sehring, Bessenbach (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 17/049,534

(22) PCT Filed: Jul. 9, 2019

(86) PCT No.: PCT/EP2019/068431

§ 371 (c)(1),
(2) Date: Oct. 21, 2020

(87) PCT Pub. No.: WO2020/016062

PCT Pub. Date: Jan. 23, 2020

(65) Prior Publication Data

US 2021/0245241 A1 Aug. 12, 2021

(30) Foreign Application Priority Data

Jul. 17, 2018 (DE) ..... 10 2018 117 302.4

(51) Int. Cl.
*H05B 6/32* (2006.01)
*B22D 39/00* (2006.01)
(Continued)

(52) U.S. Cl.
CPC ..... *B22D 39/003* (2013.01); *H05B 6/26* (2013.01); *H05B 6/32* (2013.01); *H05B 6/365* (2013.01); *H05B 6/44* (2013.01)

(58) Field of Classification Search
CPC .. B22D 39/003; B22D 13/026; B22D 13/107; B22D 13/12; B22D 21/02; B22D 21/022;
(Continued)

(56) References Cited

U.S. PATENT DOCUMENTS 2,664,496 A * 12/1953 Brace ..... H05B 6/32 219/648
2,686,864 A 8/1954 Wroughton et al.
(Continued)

FOREIGN PATENT DOCUMENTS

DE 422004 C 11/1925
DE 1565467 A1 4/1970
(Continued)

OTHER PUBLICATIONS

Albrecht Mager, "Betrachtungen und Experimente zum Schwebeschmelzen", Zeitschrift Fur Metallkunde, May 1, 1966 (May 1, 1966), pp. 358-362, vol. 57, No. 5 (Non-English ISR Relevance A).

(Continued)

*Primary Examiner* — Hung D Nguyen
(74) *Attorney, Agent, or Firm* — Barnes & Thornburg LLP; Ryan L. Marshall

(57) ABSTRACT

The invention relates to a levitation melting process and an apparatus for producing castings comprising a ring-shaped element of a conductive material for introducing the casting of a molten batch into a casting mould. In the process, the ring-shaped element is introduced into the region of the alternating electromagnetic field between the induction coils in order to cast the molten batch, thereby initiating a targeted run-off of the melt into the casting mould by influencing the induced magnetic field.

15 Claims, 5 Drawing Sheets

(51) Int. Cl.

| | |
|---|---|
| ***H05B 6/26*** | (2006.01) |
| ***H05B 6/36*** | (2006.01) |
| ***H05B 6/44*** | (2006.01) |

(58) Field of Classification Search

CPC .... B22D 21/025; B22D 27/003; B22D 27/02; B22D 27/15; B22D 5/04; B22D 1/002; H05B 6/32; H05B 6/365; H05B 6/44; B23K 26/0006; B23K 26/12; B23K 26/1224; B23K 26/127; B23K 26/1423; B23K 26/354

USPC ..... 219/647, 648, 649

See application file for complete search history.

(56) References Cited

U.S. PATENT DOCUMENTS

| | | | |
|---|---|---|---|
| 2,686,865 | A | 8/1954 | Kelly, Jr. |
| 3,363,081 | A | 1/1968 | Noiret |
| 4,578,552 | A | 3/1986 | Mortimer |
| 5,412,183 | A | 5/1995 | Buffenoir et al. |
| 5,738,163 | A | 4/1998 | Demukai et al. |
| 5,837,055 | A | 11/1998 | Yamada et al. |
| 2015/0041456 | A1 | 2/2015 | Haimer |
| 2019/0366427 | A1 | 12/2019 | Franz et al. |

FOREIGN PATENT DOCUMENTS

| | | | | |
|---|---|---|---|---|
| DE | 69617103 | | | 1/2002 |
| DE | 102017100836 | A1 | | 8/2018 |
| EP | 0747648 | | | 12/1996 |
| FR | 1416536 | A | | 11/1965 |
| JP | 2012-40590 | A | * | 3/2012 |
| JP | 2012040590 | A | | 3/2012 |
| WO | 9117644 | A1 | | 11/1991 |

OTHER PUBLICATIONS

English language translation of the International Search Report dated Oct. 17, 2019, prepared in International Application No. PCT/EP2019/068431.

* cited by examiner

LEVITATION MELTING METHOD USING AN ANNULAR ELEMENT

This application is a National Stage application of International Application No. PCT/EP2019/068431, filed Jul. 9, 2019. This application also claims priority under 35 U.S.C. § 119 to German Patent Application No. 10 2018 117 302.4, filed Jul. 17, 2018.

This invention relates to a levitation melting method and an apparatus for producing cast bodies with a ring-shaped element of a conductive material for initiating the casting of a molten batch into a mould. In this method, the ring-shaped element is introduced into the region of the electromagnetic alternating field between the induction coils in order to cast the molten batch, thus initiating a targeted flow of the melt into the casting mould by influencing the induced magnetic field.

STATE OF THE ART

Levitation melting processes are known from the state of the art. DE 422 004 A thus already reveals a melting method in which the conductive material to be melted is heated by inductive currents and at the same time kept levitating by electrodynamic action. A casting method is also described there, in which the molten material is pressed into a mould, conveyed by a magnet (electrodynamic pressed casting). The method can be carried out under vacuum.

U.S. Pat. No. 2,686,864 A also describes a process in which a conductive material to be melt is put into a levitating state e.g. in a vacuum under the influence of one or more coils without the use of a crucible. In one embodiment, two coaxial coils are used to stabilize the material in levitation. After melting, the material is dropped or cast into a mould. The process described there made it possible to keep a 60 g aluminium portion levitating. The removal of the molten metal occurs by reduction of the field strength so that the melt escapes downwards through the conically tapered coil. If the field strength is reduced very quickly, the metal falls out of the apparatus in a molten state. It has already been recognised that the "weak spot" of such coil arrangements is in the centre of the coils so that the amount of material that can be melted this way is limited.

Also U.S. Pat. No. 4,578,552 A reveals an apparatus and a method for levitation melting. The same coil is used for both heating and holding the melt, varying the frequency of the alternating current applied for controlling the heating power while keeping the current constant.

The particular advantages of levitation melting are that it avoids contamination of the melt by a crucible material or other materials that come into contact with the melt during other methods. The reaction of a reactive melt, for example titanium alloys, with the crucible material is also prevented, which would otherwise force to switch from ceramic crucibles to copper crucibles operated in the cold crucible method. The levitating melt is only in contact with the surrounding atmosphere, which can be vacuum or inert gas, for example. As there is no need to fear a chemical reaction with a crucible material, the melt can also be heated to very high temperatures. In contrast to cold crucible melting, there is also no problem that its effectiveness is very low because almost all the energy that is introduced into the melt is diverted into the cooled crucible wall, which leads to a very slow rise in temperature with high power input. In levitation melting, the only losses are due to radiation and evaporation, which are considerably lower compared to thermal conduction in the cold crucible. Thus, with a lower power input, a greater overheating of the melt is achieved in an even shorter time.

In addition, the scrap of contaminated material during levitation melting is reduced, especially in comparison to the melt in the cold crucible. Nevertheless, levitation melting has not become established in practice. The reason for this is that in the levitation melting method only a relatively small amount of molten material can be kept in levitation (see DE 696 17 103 T2, page 2, paragraph 1).

Furthermore, for performing a levitation melting method, the Lorentz force of the coil field must compensate for the weight force of the batch in order to keep it levitating. It pushes the batch upwards out of the coil field. For increasing the efficiency of the generated magnetic field, a reduction of the distance between the opposing ferrite poles is aimed at. The distance reduction allows to generate the same magnetic field at lower voltage as is required to hold a predetermined melt weight. In this way, the holding efficiency of the plant can be improved in order to let a larger batch levitate. Furthermore, the heating efficiency is also increased, as the losses in the induction coils are reduced.

The smaller the distance between the ferrite poles, the greater the induced magnetic field. However, the risk of contamination of the ferrite poles and of the induction coils with the melt increases with decreasing distance, since the field strength for the casting must be reduced. This not only reduces the holding force in the vertical direction, but also in the horizontal direction. This results in a horizontal expansion of the levitating melt slightly above the coil field, which makes it extremely difficult to drop it through the narrow gap between the ferrite poles into the casting mould positioned below without touching it. Therefore, increasing the carrying capacity of the coil field by reducing the distance of the ferrite poles is a practical limit determined by the contact probability.

The disadvantages of the methods known from the state of the art can be summarized as follows. Full levitation melting methods can only be carried out with small amounts of material, so that industrial application has not yet occurred. Furthermore, casting in casting moulds is difficult. This is particularly the case if the efficiency of the coil field in the generation of eddy currents is to be increased by reducing the distance between the ferrite poles.

OBJECTIVE

It is therefore an objective of the present invention to provide a method and an apparatus which enable the economic use of levitation melting. In particular, the method should allow the use of larger batches by improving the efficiency of the coil field and should enable a high throughput by shortened cycle times, while ensuring that the casting process occurs safely without the melt coming into contact with the coils or their poles.

DESCRIPTION OF THE INVENTION

The objective is solved by the method according to the invention and the apparatus according to the invention. According to the invention is a method for producing cast bodies from an electrically conductive material by a levitation melting method, wherein alternating electromagnetic fields are employed for causing the levitation state of a batch, said alternating electromagnetic fields being generated with at least one pair of opposing induction coils with a core of a ferromagnetic material, comprising the following steps:

introducing a batch of a starting material into the sphere of influence of at least one alternating electromagnetic field so that the batch is kept in a levitating state, melting the batch, positioning a casting mould in a filling area below the levitating batch, casting the entire batch into the casting mould by introducing a ring-shaped element of an electrically conductive material into the region of the alternating electromagnetic field between the induction coils, removal of the solidified cast body from the casting mould.

The volume of the molten batch is preferably sufficient to fill the casting mould to a level sufficient for producing a cast body ("filling volume"). After filling the casting mould, it is allowed to cool or cooled with coolant so that the material solidifies in the mould. The cast body can then be removed from the mould.

A "conductive material" of a batch is understood to be a material, which has a suitable conductivity in order to heat the material inductively and keep it in levitation.

With regard to the ring-shaped element, an "electrically conductive material" is understood to be a material whose electrical conductivity is at least so great that it is possible for the surrounding magnetic field to be influenced by eddy currents induced in the ring-shaped element.

A "levitating state" according to the invention is defined as a state of complete levitation so that the treated batch has no contact whatsoever with a crucible or platform or the like.

The term 'ferrite pole' is used synonymously with the term "core of ferromagnetic material" in this application. Likewise, the terms "coil" and "induction coil" are employed synonymously side by side.

By moving the induction coil pairs closer together, the efficiency of the generated alternating electromagnetic field can be increased. This makes it possible to make heavier batches levitate, too. However, when casting a batch, the risk of touching the molten batch with the coils or ferrite poles increases with decreasing free cross-section between the coils. However, such impurities must be strictly avoided, as they are difficult and time-consuming to remove and therefore result in a prolonged downtime of the plant. In order to be able to exploit the advantages of the narrower distance of the pairs of induction coil pairs as far as possible, without having to accept the risk of impurities during casting, the casting of the batch is initiated by slowly introducing a ring-shaped element of an electrically conductive material into the magnetic field below the levitating batch. The current intensity in the field generating coils is left unchanged until the casting process is finished.

In the ring-shaped element, eddy currents are induced by the surrounding electromagnetic alternating field, which influence the external magnetic field. The term "ring-shaped" according to the invention means not only circular elements as well as full-surface elements, but any polyhedral object which fulfils the following two conditions:

1. The surface of the object forms a closed contour so that the magnetic flux is not able to flow through this object, but has to flow around it. This way, a magnetic field minimum can be generated under the melt.

2. The object has an opening in its centre that allows the melt to flow through it.

Examples for such full-surface ring-shaped elements according to the invention are, therefore, besides a cylindrical tube, also tubular structures based on polygonal elements, which form an essentially round structure, such as polygons with five or more corners. Examples of ring-shaped elements that do not cover the entire surface are cubes or parallelepipeds, which, as in a lattice model, are only formed by their edges from a conductive material.

Particularly large magnetic field induction occurs at the ends of the ring-shaped element, which reliably prevents the melt from touching the upper edge of the ring-shaped element when it passes through the coil plane. Since a reduction of the surrounding magnetic field occurs at the same time in the centre of the ring-shaped element, a funnel effect is produced for the melt, which can pass through this magnetic funnel in a targeted manner and without splashing into the casting mould positioned below of the ring-shaped element. The remaining melt continues to levitate above the ring-shaped element, while it slowly runs off in its centre. It is advantageous that the diameter of the ring-shaped element corresponds to the diameter of the funnel-shaped filling section of the casting mould or is slightly smaller.

In contrast to the known levitation melting processes, the casting of the batch is not achieved by eliminating the Lorentz force of the magnetic field, which compensates the weight force, by reducing the current strength in the coils or even completely switching off the coils, but only by purposefully manipulating the magnetic field course with the ring-shaped element.

In one embodiment, the electrically conductive material of the ring-shaped element contains one or more elements from the group consisting of silver, copper, gold, aluminium, rhodium, tungsten, zinc, iron, platinum and tin. In particular, this includes alloys such as brass and bronze. The group consists particularly preferably of silver, copper, gold and aluminium. The most preferred electrically conductive material of the ring-shaped element is copper, whereby up to 5% by weight of foreign components may be present.

In a particularly advantageous embodiment of the invention, the ring-shaped element tapers conically on the side, which is first introduced into the region of the electromagnetic alternating field. While this results in a reduced diameter available for the melt to run off, it reduces the risk of the ring-shaped element inside being touched and contaminated by the melt. The magnetic field induction, which is more inwardly directed on the obliquely oriented shell and reinforced by the smaller diameter, reliably ensures that the melt can enter the ring-shaped element without contact despite the smaller passage area. The melt jet thus concentrated in the centre of the ring-shaped element thus has an optimum distance to the ring wall in the then expanding diameter.

In a preferred design variant, the ring-shaped element is hollow-walled and this cavity is filled with a phase change material (PCM). This allows effective cooling of the ring-shaped element, which heats up when the melt is cast in the alternating field of the induction coils.

Preferably, the ring-shaped element is cooled in such a way that it rests on a cooled bearing surface during the melting process. This can be cooled intensively to regenerate the phase change material during the next melting process and to cool the ring-shaped element again before it is lifted into the alternating field again for the next casting process.

A particularly preferred design variant for this is for the ring-shaped element to be lifted between the induction coils to be introduced into the region of the alternating electromagnetic field from the casting mould. The ring-shaped element has suitable means to ensure that it is carried along when the casting mould is lifted into the casting position, such as a collar-like cross-sectional reduction at the upper end to a diameter smaller than the upper cross-section of the casting mould, or pins that can engage in appropriately designed receptacles on the casting mould. In the case of ring-shaped elements with a conically tapered area, this can serve as a means of entrainment. When the casting mould is lowered after casting, the ring-shaped element is then placed back on the cooled bearing surface and the casting mould can be removed downwards. This has the advantage that only one ring-shaped element has to be present per melting plant and this is used jointly by different casting moulds. Since the casting mould takes over the lifting, an additional mechanism for lifting the ring-shaped element can be dispensed with in the melting plant, which simplifies and reduces the cost of its construction.

Another highly advantageous embodiment envisages that the ring-shaped element is a part of the casting mould. The ring-shaped element can be arranged collar-like around the upper edge of the generally funnel-shaped filling section of the casting mould. Alternatively, it could also form the extension of the upper diameter of the filling section. Due to the funnel effect of the ring-shaped element, the diameter of the funnel-shaped filling section of the casting mould can be smaller than usual, so that the diameter can be reduced to such an extent that the upper end of the casting mould can be inserted into the area between the coils.

This further simplifies and accelerates the melting process, as the casting mould has to be lifted from a feed position to the casting position below the coil arrangement anyway. In order to cast in accordance with the invention, this lifting must then only take place slightly higher. This eliminates the need for an additional mechanism to lift the ring-shaped element separately. In addition, the lifting of the mould into the casting position can be combined with the casting itself. In the case of lost ceramic moulds in particular, the ring-shaped element can also be designed to be removable so that it can be removed before the mould is broken and immediately reusable on a new mould. For example, this can be done by platform-like extension of the upper part of the casting mould, onto which the ring-shaped element can be placed when it is pushed over the edge of the funnel-shaped filling section.

The electrically conductive material used in accordance with the invention as a batch has in a preferred embodiment at least one high-melting metal from the following group: titanium, zirconium, vanadium, tantalum, tungsten, hafnium, niobium, rhenium, molybdenum. Alternatively, a less high-melting metal such as nickel, iron or aluminium can also be employed. A mixture or alloy with one or more of the above metals can also be employed as a conductive material. Preferably, the metal has a proportion of at least 50% by weight, in particular at least 60% by weight or at least 70% by weight, of the conductive material. It has been shown that these metals particularly benefit from the advantages of the present invention. In a particularly preferred embodiment, the conductive material is titanium or a titanium alloy, in particular TiAl or TiAlV.

These metals or alloys can be processed in a particularly advantageous way, as they have a pronounced dependence of viscosity on temperature and are also particularly reactive, especially with regard to the materials of the casting mould. Since the method according to the invention combines contactless melting in levitation with extremely fast filling of the casting mould, a particular advantage can be realized for such metals. The method according to the invention can be used to produce cast bodies, which exhibit a particularly thin or even no oxide layer at all from the reaction of the melt with the material of the casting mould. And especially in the case of high-melting metals, the improved utilization of the induced eddy current and the exorbitant reduction of heat losses due to thermal contact are noticeable with regard to the cycle times. Furthermore, the carrying capacity of the generated magnetic field can be increased so that heavier batches can also be kept in levitation.

In an advantageous embodiment of the invention, the conductive material is superheated during melting to a temperature, which is at least 10° C., at least 20° C. or at least 30° C. above the melting point of the material. Overheating prevents the material from solidifying instantly on contact with the casting mould, whose temperature is below the melting temperature. It is achieved that the batch can distribute in the casting mould before the viscosity of the material becomes too high. An advantage of levitation melting is that no crucible has to be used which is in contact with the melt. This avoids the high material loss of the cold crucible process on the crucible wall as well as contamination of the melt by crucible components. A further advantage is that the melt can be heated to a relatively high temperature, since operation in vacuum or under protective gas is possible and there is no contact with reactive materials. Nevertheless, most materials cannot be overheated arbitrarily, as otherwise a violent reaction with the casting mould is to be feared. Therefore, overheating is preferably limited to a maximum of 300° C., in particular to a maximum of 200° C. and particularly preferably to a maximum of 100° C. above the melting point of the conductive material.

In the method, at least one ferromagnetic element is arranged horizontally around the area in which the batch is melted in order to concentrate the magnetic field and to stabilize the batch. The ferromagnetic element can be arranged ring-shaped around the melting area, wherein "ring-shaped" means not only circular elements, but also angular, in particular square or polygonal ring elements. The ferromagnetic element may also have several bar sections, which protrude in particular horizontally in the direction of the melting area. The ferromagnetic element consists of a ferromagnetic material, preferably with an amplitude permeability $\mu_a>10$, more preferably $\mu_a>50$ and particularly preferably $\mu_a>100$. Amplitude permeability refers in particular to permeability in a temperature range between 25° C. and 150° C. and at a magnetic flux density between 0 and 500 mT. The amplitude permeability amounts in particular at least one hundredth, and in particular at least 10 hundredth or 25 hundredth, of the amplitude permeability of soft magnetic ferrite (e.g. 3C92). The person skilled in the art knows suitable materials.

In one embodiment, the electromagnetic fields are generated by at least two pairs of induction coils, the longitudinal axes of which are horizontally aligned, so that the conductors of the coils are preferably each mounted on a horizontally aligned coil body. The coils can each be arranged around a bar section of the ferromagnetic element projecting in the direction of the melting range. The coils can have coolant-cooled conductors.

According to the invention, there is also an apparatus for levitation melting an electrically conductive material, comprising at least one pair of opposing induction coils with a core of a ferromagnetic material for causing the levitation state of a batch by means of alternating electromagnetic fields and a ring-shaped element made of an electrically conductive material which can be introduced into the region of the alternating electromagnetic field between the induction coils.

Furthermore in accordance to the invention is the use of a ring-shaped member consisting of an electrically conductive material and being part of a casting mould in a levitation melting process for casting a batch into the casting mould by introducing it into the region between the induction coils, that create an alternating electromagnetic field for causing the levitation state of the batch.

DESCRIPTION OF THE FIGURES

The figures show preferred embodiments. They are for illustrative purposes only.

Figure 1:
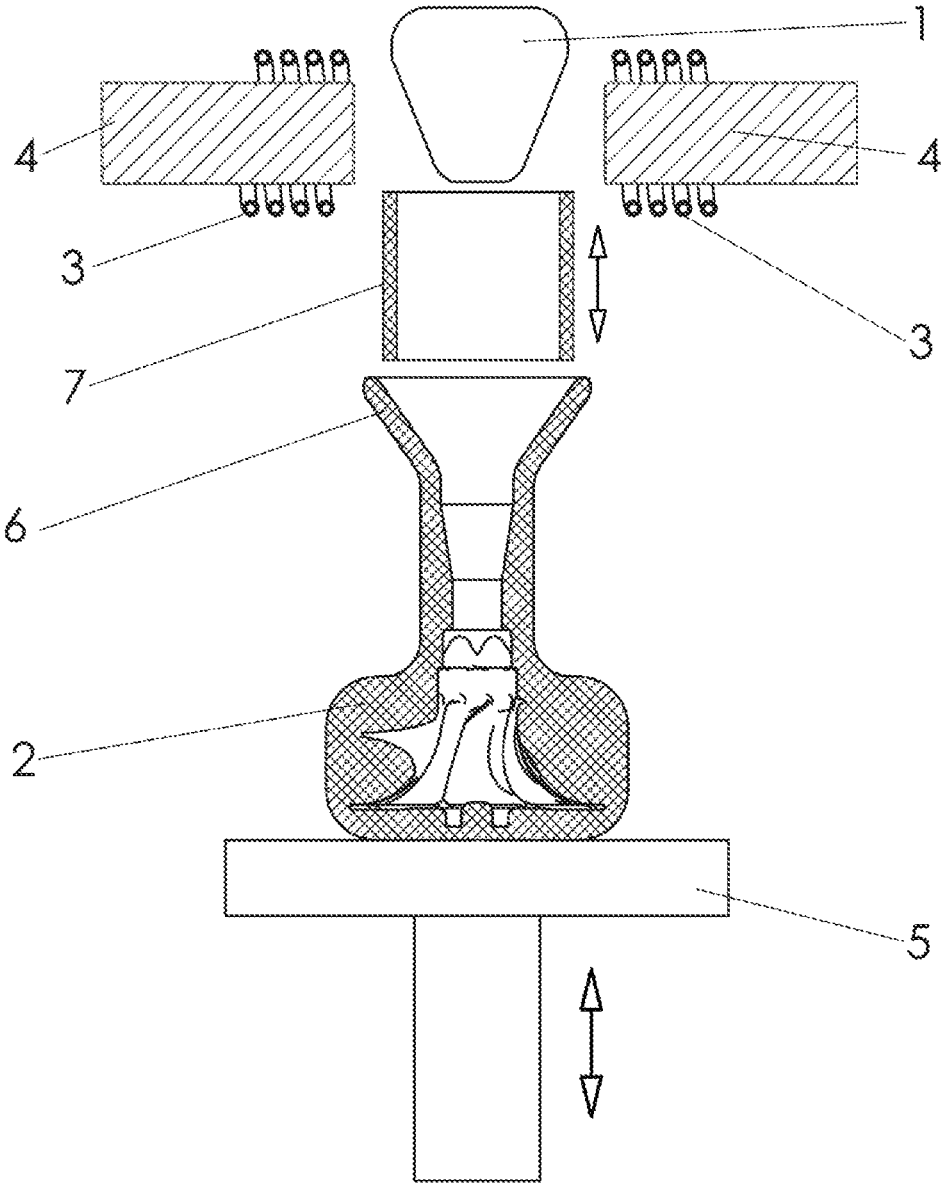
FIG. 1 is a lateral cross-sectional view of a casting mould below a melting area with ferromagnetic elements, coils, a ring-shaped element and a batch of conductive material.

FIG. 1 shows a batch (1) of conductive material which is in the influence region of alternating electromagnetic fields (melting area) generated by the coils (3). Below the batch (1) there is an empty casting mould (2) which is held in the filling area by a holder (5). The casting mould (2) has a funnel-shaped filling section (6). The holder (5) is suitable for lifting the casting mould (2) from a feeding position to a casting position, which is symbolized by the drawn arrow. A ferromagnetic element (4) is arranged in the core of the coils (3). The axes of the pair of coils (3) are horizontally aligned, wherein each two opposing coils (3) are forming a pair. Between the batch (1) and the funnel-shaped filling section (6) of the casting mould (2), the ring-shaped element (7) is arranged below the pair of coils (3). As symbolized by the arrow, it is vertically movable.

The batch (1) is melted while levitating in the process according to the invention and cast into the casting mould (2) after the melt has occurred. For casting, the ring-shaped element (7) is slowly lifted into the region of the magnetic field between the coils (3). As a result, the melt passes slowly and in a controlled manner through the ring-shaped element (7) into the casting mould (2) without contaminating the coils (3) or their cores and the inside of the ring-shaped element (7) or spraying inside the funnel-shaped filling portion (6) of the casting mould (2).

Figure 2:
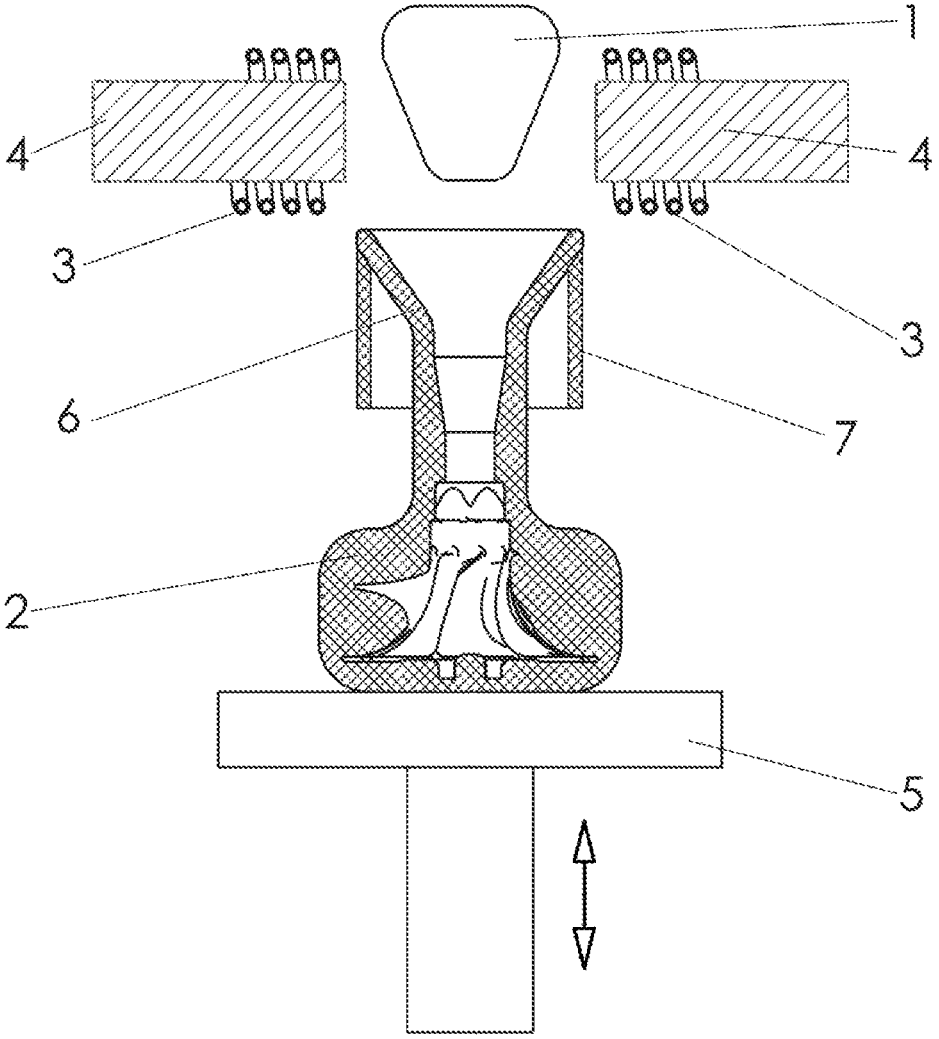
FIG. 2 is a lateral cross-sectional view of a variant of FIG. 1 in which the ring-shaped element is part of the casting mould.

FIG. 2 shows a design variant analogous to FIG. 1, in which the ring-shaped element (7) is part of the casting mould (2). In the variant shown, the ring-shaped element (7) is designed as a collar around the funnel-shaped filling section (6) of the casting mould (2). While the holder (5) in the variant of FIG. 1 remains in the position shown during casting and only the ring-shaped element (7) is moved by a mechanism which is not illustrated, here the entire casting mould (2) with the holder (5) is moved further upwards from the position shown for casting. This has the additional advantage that the distance between the melt and the funnel-shaped filling section (6) is reduced at the same time, thus minimizing the free-fall distance of the melt. This ensures that spraying can be safely ruled out.

The FIG. 3 show a step-by-step casting process using a design variant with a ring-shaped element (7) with conical taper on the upper side. The drawing does not show the casting mould (2) arranged below the ring-shaped element (7).

Figure 3A:
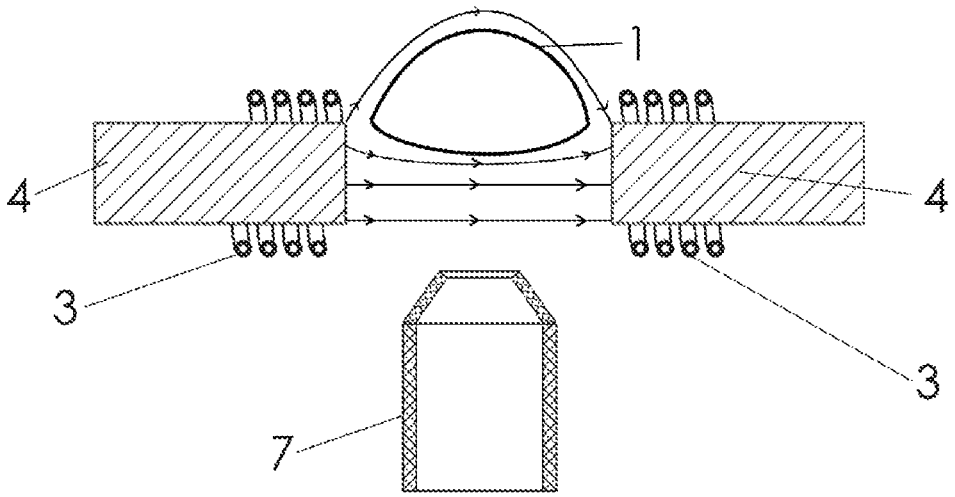
FIGS. 3*a* to 3*c* are a lateral cross-sectional view of a variant with a ring-shaped element with conical tapering in the course of the casting process.

FIG. 3*a* shows the stage at the end of the melting process. The ring-shaped element (7) is located below the magnetic field of the coils (3). The melt levitates in the area above the coils (3). The drawn magnetic field lines run freely between the poles of ferromagnetic material (4) of the coils (3).

Figure 3B:
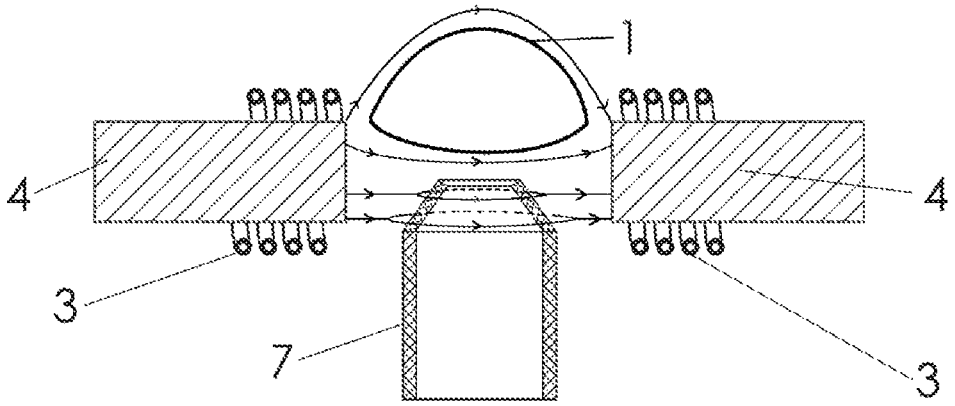

FIG. 3*b* shows the situation at the beginning of the entry of the ring-shaped element (7) into the magnetic field of the coils (3). As can be seen, the magnetic field lines are increasingly deflected, especially in the region of the cone, and guided around the ring-shaped element (7) so that they do not penetrate the area inside the cone and the cylindrical part. In the drawing, the field lines running behind the ring-shaped element (7) are shown dashed. The density of the Lorentz force increases strongly along the inclination to the tips of the ring-shaped element (7) due to the magnetic field generated by the eddy currents in the ring-shaped element (7).

Figure 3C:
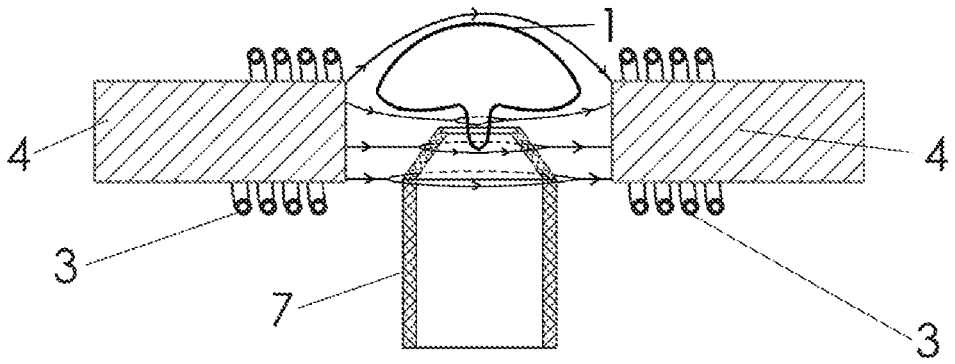

FIG. 3*c* finally shows the situation at the beginning of the casting. In the centre of the ring-shaped element (7), the funnel effect generated by the deflected magnetic forces has formed the beginning of a melt jet. The first large drop of the melt of the batch (1) already protrudes into the opening of the cone, whereby the magnetic field at the tip of the cone ensures both the constriction of the levitating batch (1) at its underside and prevents contact. Accordingly, the volume of the melt in the coil area has already slightly decreased. In the drawing, the magnetic field lines running behind the ring-shaped element (7) and the melt drop are again shown dotted. The ring-shaped element (7) is now continuously and slowly pushed upwards until the entire melt of the batch (1) has run off into the casting mould (2).

The FIG. 4 show a casting process using a design variant with a ring-shaped element (7) step-by-step with phase change material in the cavity wall and a cooled bearing surface.

Figure 4A:
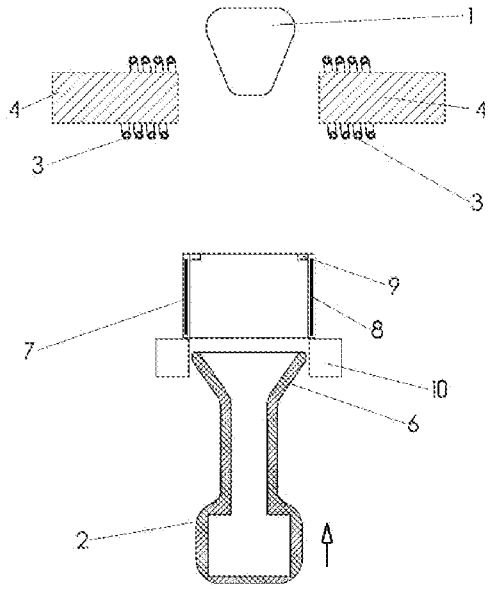
FIGS. 4*a* to 4*d* are a lateral cross-sectional view of a variant with a ring-shaped element with phase change material in the course of the casting process.

FIG. 4*a* shows the situation at the end of the melting process. The finished melt (1) levitates above the induction coils (3) with their cores of ferromagnetic material (4). The casting mould (2) with its funnel-shaped filling section (6) is provided below. For casting, the casting mould (2) is moved upwards as indicated by the arrow. In this example, the casting is initiated by a ring-shaped element (7) in cylindrical tube form, which is filled with a phase change material (8) in the hollow wall. During the melting phase it rests on the strongly cooled bearing surface (10). When the casting mould (2) is lifted, the filling section passes through the cooled bearing surface into the ring-shaped element (7) and lifts the ring-shaped element (7) by means of the collar (9). The ring-shaped member (7) and the cooled bearing surface (10) on which it rests are dimensioned in their inner diameter so as to surround the upper outer diameter of the filling section (6) with little clearance. The flange-like collar (9) protrudes inwards just enough to sit on the edge of the filling section (6) without covering the funnel surface.

Figure 4B:
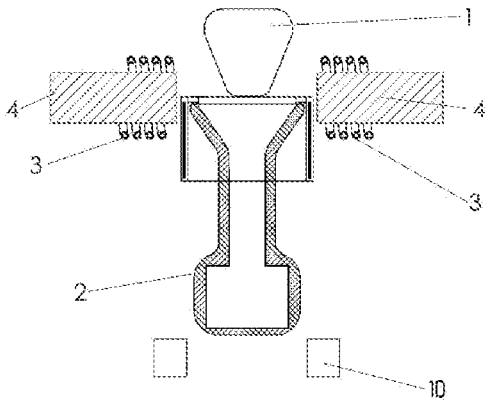

FIG. 4*b* shows the situation at the beginning of the casting process. The casting mould (2) with the ring-shaped element (7) turned over has been lifted into the coil field to below the levitating melt (1). To carry out the casting, they are now pushed a little further up until the melt (1) has run off into the casting mould (2). The ring-shaped element (7) heats up due to the radiant heat of the melt (1) and the alternating magnetic field. The increase in temperature can be reduced or delayed by the phase change of the phase change material (8) inside the ring-shaped element (7).

Figure 4C:
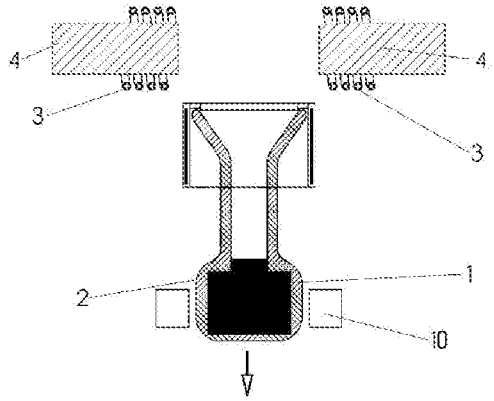

FIG. 4*c* shows the casting mould (2) filled with the melt (1) after casting again in the direction of the arrow on the way down. It deposits the hot ring-shaped element (7) again on the cooled bearing surface (10), where it is cooled for the next melt batch with a renewed phase change of the phase change material (8).

Figure 4D:
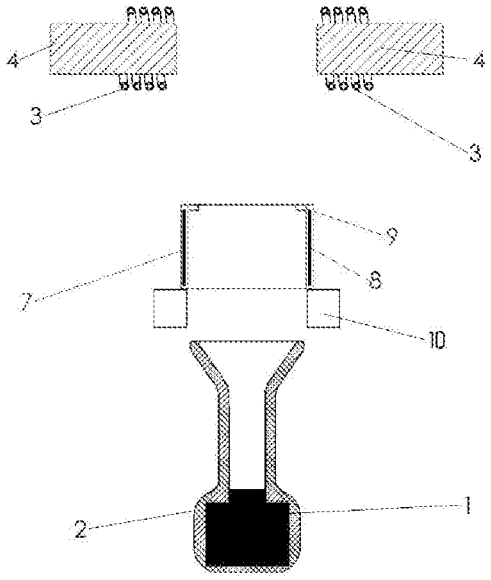

This state at the end of the casting process is shown in FIG. 4*d*. The casting mould (2) has been completely lowered through the cooled bearing surface (10) and can now be exchanged for a new empty mould. The ring-shaped element (7) rests again on the cooled bearing surface (10) as shown in FIG. 4*a*. When the new casting mould (2) is positioned, the next melting process can be started by introducing the next batch (1) into the magnetic field.

Figure 5:
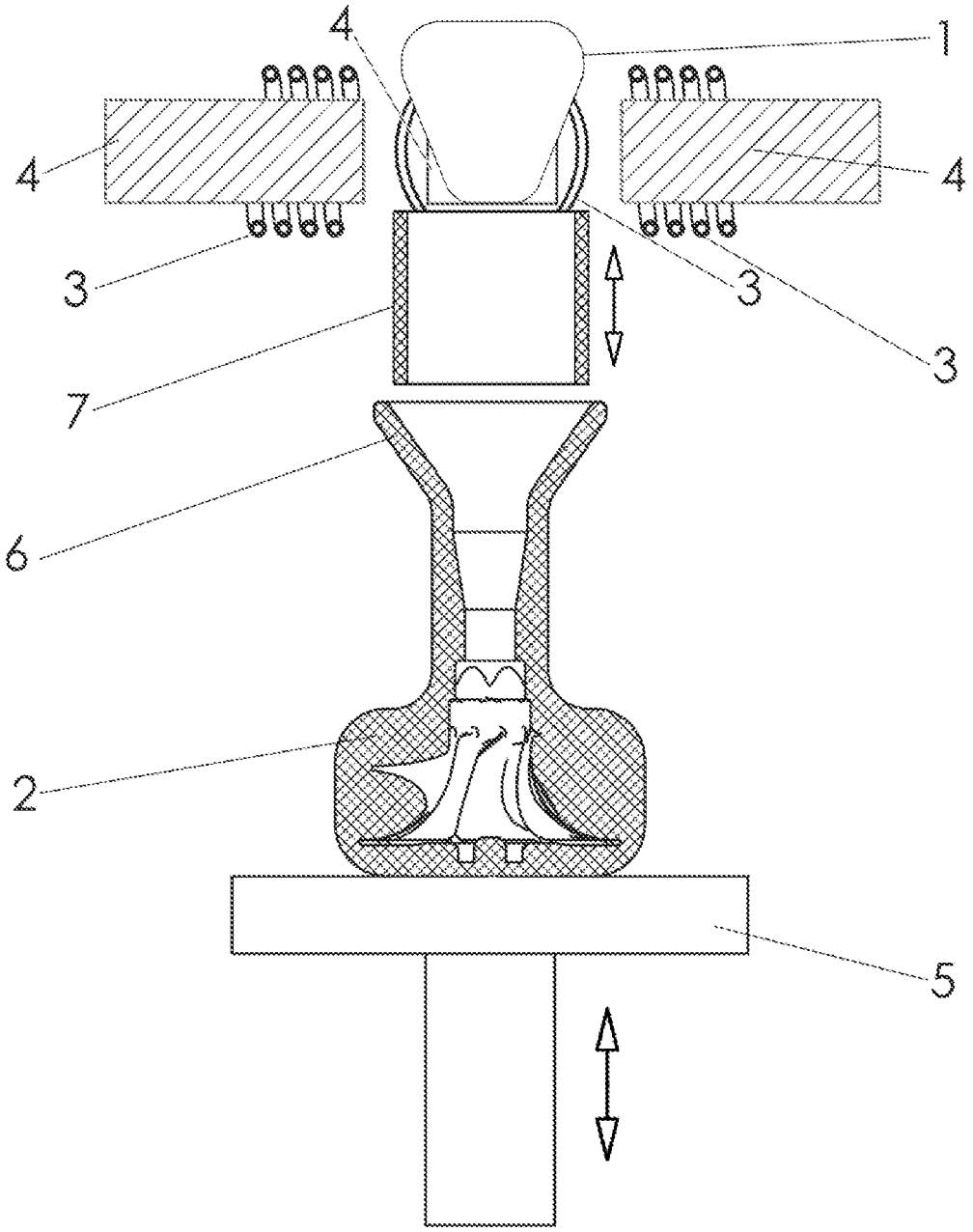

FIG. 5 is a lateral cross-sectional view of an embodiment analogue to FIG. 1 now comprising two pairs of induction coils.

LIST OF REFERENCE NUMERALS

1 batch
2 casting mould
3 induction coil
4 ferromagnetic material
5 holder
6 filling section
7 ring-shaped element
8 phase change material
9 collar
10 cooled bearing surface

The invention claimed is:

1. A method for producing cast bodies from an electrically conductive material by a levitation melting method, wherein alternating electromagnetic fields levitate a batch, the alternating electromagnetic fields being generated with at least one pair of opposing induction coils with a core of a ferromagnetic material, comprising:

introducing a batch of a starting material into a sphere of influence of at least one alternating electromagnetic field so that the batch is kept in a levitating state;

melting the batch;

positioning a casting mold in a filling area below the levitating batch;

casting the entire batch into the casting mold by introducing a ring-shaped element of an electrically conductive material into the region of the electromagnetic alternating field between the induction coils;

removing a solidified cast body from the casting mold.

2. The method according to claim 1, wherein the electrically conductive material of the ring-shaped element contains one or more elements selected from the group consisting of: silver, copper, gold, aluminium, rhodium, tungsten, zinc, iron, platinum and tin.

3. The method according to claim 1, wherein the ring-shaped element tapers conically on a side first introduced into the alternating electromagnetic field region.

4. The method according to claim 1, wherein the ring-shaped element is a part of the casting mold.

5. The method according to claim 1, wherein the electromagnetic fields are generated with at least two pairs of induction coils.

6. The method according to any of claim 1, wherein the ring-shaped element is hollow-walled forming a cavity, and this cavity is filled with a phase change material.

7. The method according to claim 6, wherein the ring-shaped element rests on a cooled bearing surface during the melting process.

8. The method according to claim 7, wherein the ring-shaped element is raised by the casting mold for introduction into the region of the alternating electromagnetic field between the induction coils.

9. An apparatus for levitation melting an electrically conductive material, comprising at least one pair of opposing induction coils with a core of a ferromagnetic material for levitating a batch by means of alternating electromagnetic fields and a ring-shaped member of electrically conductive material insertable in the region of the alternating electromagnetic field between the induction coils.

10. The apparatus according to claim 9, wherein the electrically conductive material of the ring-shaped element contains one or more elements from the group consisting of: silver, copper, gold, aluminium, rhodium, tungsten, zinc, iron, platinum and tin.

11. The apparatus according to claim 9, wherein the ring-shaped element tapers conically on a side first introduced into the region of the alternating electromagnetic field.

12. The apparatus according to claim 9, wherein the electromagnetic fields are generated with at least two pairs of induction coils.

13. The apparatus according to claim 9, wherein the ring-shaped element is hollow-walled forming a cavity, and this cavity is filled with a phase change material.

14. The apparatus according to claim 13, wherein the ring-shaped element rests on a cooled bearing surface during the melting process.

15. A ring-shaped element consisting of an electrically conductive material and forming part of a casting mold in a levitation melting process for casting a batch into the casting mold by introducing into the region between induction coils that generate an alternating electromagnetic field levitating the batch.

* * * * *